US009194601B2

(12) United States Patent
Kuroiwa et al.

(10) Patent No.: US 9,194,601 B2
(45) Date of Patent: Nov. 24, 2015

(54) AIR CONDITIONING CONTROL DEVICE, AIR CONDITIONING CONTROL METHOD AND PROGRAM

(75) Inventors: Takeru Kuroiwa, Tokyo (JP); Taichi Ishizaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 368 days.

(21) Appl. No.: 13/814,772

(22) PCT Filed: Jan. 31, 2011

(86) PCT No.: PCT/JP2011/051916
§ 371 (c)(1),
(2), (4) Date: Feb. 7, 2013

(87) PCT Pub. No.: WO2012/035789
PCT Pub. Date: Mar. 22, 2012

(65) Prior Publication Data

US 2013/0131872 A1 May 23, 2013

(30) Foreign Application Priority Data

Sep. 13, 2010 (JP) ..... 2010-204974

(51) Int. Cl.
*G01M 1/38* (2006.01)
*G05B 13/00* (2006.01)
(Continued)

(52) U.S. Cl.
CPC ..... *F24F 11/0086* (2013.01); *F24F 2011/0094* (2013.01)

(58) Field of Classification Search
CPC ... F24F 11/0086; F24F 11/0091; G05B 15/02
USPC ..... 700/276
See application file for complete search history.

(56) References Cited

U.S. PATENT DOCUMENTS

2008/0185450 A1* 8/2008 Kwon et al. ..... 236/51
2011/0047909 A1* 3/2011 Katsui et al. ..... 52/302.1
(Continued)

FOREIGN PATENT DOCUMENTS

JP 64-29979 A 1/1989
JP 01-263450 A 10/1989
(Continued)

OTHER PUBLICATIONS

International Search Report of the International Searching Authority mailed Apr. 5, 2011 for the corresponding international application No. PCT/JP2011/051916 (with English translation).
(Continued)

*Primary Examiner* — Ronald Hartman, Jr.
(74) *Attorney, Agent, or Firm* — Posz Law Group, PLC

(57) ABSTRACT

An air conditioning control device includes; a storage unit configured to store a drawing illustrating a floorplan indicating where one or more air conditioners are installed and separated areas within the floorplan; an area specifying unit configured to specify areas where the one or more air conditioners are installed on the basis of the stored drawing; a number specifying unit configured to specify the number of air conditioners within the respective specified areas; and an air conditioner control unit configured to control operation of each air conditioner within the specified areas on the basis of the specified number of air conditioners. This permits automatically specifying the positions of each air conditioner and the number of air conditioners on the basis of the drawing, thereby facilitating input setting for each air conditioner.

8 Claims, 18 Drawing Sheets

(51) Int. Cl.

| | |
|---|---|
| ***G05B 15/00*** | (2006.01) |
| ***G05D 23/00*** | (2006.01) |
| ***F24F 11/00*** | (2006.01) |

(56) References Cited

U.S. PATENT DOCUMENTS

| | | | | |
|---|---|---|---|---|
| 2011/0098863 | A1* | 4/2011 | Miki | 700/275 |
| 2011/0126144 | A1* | 5/2011 | Sakaguchi et al. | 715/771 |
| 2011/0175701 | A1* | 7/2011 | Kobayashi | 340/3.7 |
| 2013/0138249 | A1* | 5/2013 | Cho et al. | 700/276 |
| 2013/0166074 | A1* | 6/2013 | Hattori et al. | 700/276 |
| 2013/0174594 | A1* | 7/2013 | Yamashita et al. | 62/179 |
| 2013/0261805 | A1* | 10/2013 | Kuroiwa et al. | 700/276 |
| 2014/0058569 | A1* | 2/2014 | Kuroiwa | 700/276 |
| 2014/0081467 | A1* | 3/2014 | Sato | 700/276 |
| 2014/0316583 | A1* | 10/2014 | Ambriz et al. | 700/277 |
| 2015/0067562 | A1* | 3/2015 | Sasaki et al. | 715/769 |

FOREIGN PATENT DOCUMENTS

| | | | |
|---|---|---|---|
| JP | 02-100777 | A | 4/1990 |
| JP | 11-134509 | A | 5/1999 |
| JP | 11-287496 | A | 10/1999 |
| JP | 2000-285190 | A | 10/2000 |
| JP | 2005-127618 | A | 5/2005 |
| JP | 2007-40584 | A | 2/2007 |
| JP | 2009-205618 | A | 9/2009 |
| JP | 2009-257617 | A | 11/2009 |
| JP | 2010-7887 | A | 1/2010 |
| JP | 2010-32190 | A | 2/2010 |

OTHER PUBLICATIONS

Office Action mailed Dec. 10, 2013 issued in corresponding JP patent application No. 2012-533877 (and English translation).

* cited by examiner

FIG. 3

361

| AREA NAME | AIR CONDITIONER NAME | | |
|---|---|---|---|
| AREA 01 | AIR CONDITIONER 01 | AIR CONDITIONER 02 | |
| AREA 02 | AIR CONDITIONER 03 | | |
| AREA 03 | AIR CONDITIONER 04 | AIR CONDITIONER 05 | AIR CONDITIONER 06 |
| ⋮ | ⋮ | | |

FIG. 4

| AIR CONDITIONER NAME | SETTINGS (OPERATION MODE, TEMPERATURE, AIRFLOW, WIND DIRECTION) (362) | ENERGY SAVING CONTROL SETTING (363) |
|---|---|---|
| AIR CONDITIONER 01 | COOLING, 25 °C, WEAK, AUTOMATIC | ON / OFF; 6:00, 12:00, 18:00, 24:00; TIME |
| AIR CONDITIONER 02 | DEHUMIDIFICATION, 28 °C STRONG, FIXED | |
| ⋮ | ⋮ | ⋮ |

FIG. 12

363

| AREA NAME | AIR CONDITIONER NAME | ENERGY SAVING CONTROL SETTING |
|---|---|---|
| AREA 01 | AIR CONDITIONER 01 | ON / OFF / TIME |
| | AIR CONDITIONER 02 | |
| AREA 02 | AIR CONDITIONER 03 | |
| AREA 03 | AIR CONDITIONER 04 | |
| | AIR CONDITIONER 05 | |
| | AIR CONDITIONER 06 | |

FIG. 16

361

| AREA NUMBER | OPERATION UNIT NUMBER | AIR CONDITIONER NUMBER |
|---|---|---|
| 01 | 1 | 01, 02 |
| | 2 | 03, 04 |
| 02 | 3 | 05, 06 |
| 03 | 4 | 07, 08 |
| 04 | 5 | 09 |

FIG. 18

363

| AREA NAME | OPERATION UNIT NAME | AIR CONDITIONER NAME | ENERGY SAVING CONTROL SETTING |
|---|---|---|---|
| AREA 01 | OPERATION UNIT 1 | AIR CONDITIONER 01 | ON / OFF / TIME |
| | | AIR CONDITIONER 02 | |
| | OPERATION UNIT 2 | AIR CONDITIONER 03 | |
| | | AIR CONDITIONER 04 | |
| AREA 02 | OPERATION UNIT 3 | AIR CONDITIONER 05 | |
| | | AIR CONDITIONER 06 | |
| AREA 03 | OPERATION UNIT 4 | AIR CONDITIONER 07 | |
| | | AIR CONDITIONER 08 | |
| AREA 04 | OPERATION UNIT 5 | AIR CONDITIONER 09 | |

AIR CONDITIONING CONTROL DEVICE, AIR CONDITIONING CONTROL METHOD AND PROGRAM

CROSS REFERENCE TO RELATED APPLICATIONS

This application is a U.S. national stage application of PCT/JP2011/051916 filed on Jan. 31, 2011, and claims priority to, and incorporates by reference, Japanese Patent Application No. 2010-204974 filed on Sep. 13, 2010.

TECHNICAL FIELD

The present invention relates to an air conditioning control device, an air conditioning control method and a program.

BACKGROUND ART

By controlling an operating time or a non-operating time of an air conditioner, power consumed by the air conditioner can be reduced. For example, in a large room where a plurality of air conditioners are installed, the air conditioners are operated while operating time of the air conditioners being shifted from one to another, not simultaneously operating the air conditioners, thereby saving power and maintaining comfort. Patent Literature 1 describes that installed air conditioners are divided into groups, and operation of air conditioners are controlled on an air conditioner-by-air conditioner basis within each group (see, for example, Patent Literature 1).

In a drawing illustrating the position of an conditioner, a method to input settings of the air conditioners is described (see, for example, Patent Literature 2).

PRIOR ART LITERATURE

Patent Literature

Patent Literature 1: Unexamined Japanese Patent Application Kokai Publication No. 2005-127618

Patent Literature 2: Unexamined Japanese Patent Application Kokai Publication No. 2010-7887

DISCLOSURE OF THE INVENTION

Problem to be Solved by the Invention

However, in a configuration disclosed in Patent Literature 1, an area to be air-conditioned, and a position of each air conditioner and the number air conditioners within the area must be inputted and set by a user, and input setting process is complicated. In addition, in a small room where only one air conditioner is installed, it is difficult to maintain comfort and save energy. In a configuration disclosed in Patent Literature 2, similarly, an area to be air-conditioned and a position of each air conditioner and the number of air conditioners within the area must be inputted and set by a user, input setting process is complicated. Furthermore, a user must set an operation pattern for each air conditioner on an air conditioner-by-air conditioner basis, taking into consideration the position of each air conditioner and the number of air conditioners within an area to be air-conditioned. Thus, a new method is desired that permits easily inputting an area to be air-conditioned and the position of each air conditioner and the number of air conditioners within the area and appropriately controlling operation of each air conditioner on the basis of the area to be air-conditioned, the position of each air conditioner, and the number of air conditioners that were set in this way.

The present invention was made in view of the above circumstances, and facilitates input setting for an area to be air-conditioned and for a position of each air conditioner and for the number of air conditioners within the area.

An objective of the present invention is to provide an air conditioning control device, an air conditioning control method and a program that are suitable for specifying a position of each air conditioner and the number of air conditioners on the basis of a drawing and controlling operation of each air conditioner on the basis of the specified position and number thereby to maintain comfort and save energy.

Means for Solving the Problem

In order to achieve the above objective, an air conditioning control device according to the present invention includes:

a storage unit configured to store a drawing illustrating a floorplan indicating where one or more air conditioners are installed and where separated areas are designated within the floorplan;

an area specifying unit configured to specify areas where the one or more air conditioners are installed on the basis of the stored drawing;

a number specifying unit configured to specify the number of air conditioners within the respective specified areas; and an air conditioner control unit configured to control operation of each air conditioner installed within the specified areas on the basis of the specified number of air conditioners.

Effects of the Invention

In the present invention, a position of each air conditioner and the number of air conditioners are automatically specified on the basis of drawings. Accordingly, input setting for each air conditioner is easier. Moreover, since operation of each air conditioner is controlled on the basis of the specified position and number, comfort can be maintained and also energy can be saved.

BRIEF DESCRIPTION OF DRAWINGS

FIG. 3 is a table illustrating an example of air conditioner connection information stored in a storage unit;

FIG. 4 is a table illustrating an example of air conditioner state information and air conditioner control information stored in a storage unit;

FIG. 12 is a table illustrating an example of operation settings for controlling operation of each air conditioner;

FIG. 16 is a table illustrating an example in which air conditioner connection information is grouped for each operation unit;

FIG. 18 is a table illustrating an example of operation settings for controlling operation of one or more air conditioners that are grouped for each operation unit.

MODE FOR CARRYING OUT THE INVENTION

First Embodiment

Hereinafter, embodiments of the present invention will be described. The below mentioned embodiments are given for explaining the present invention and do not confine the scope of the present invention. Accordingly, a person skilled in the art could employ embodiments in which part or all of elements of the below mentioned embodiments are substituted by equivalent(s) thereof, and these embodiments are also within the scope of the present invention.

Figure 1:
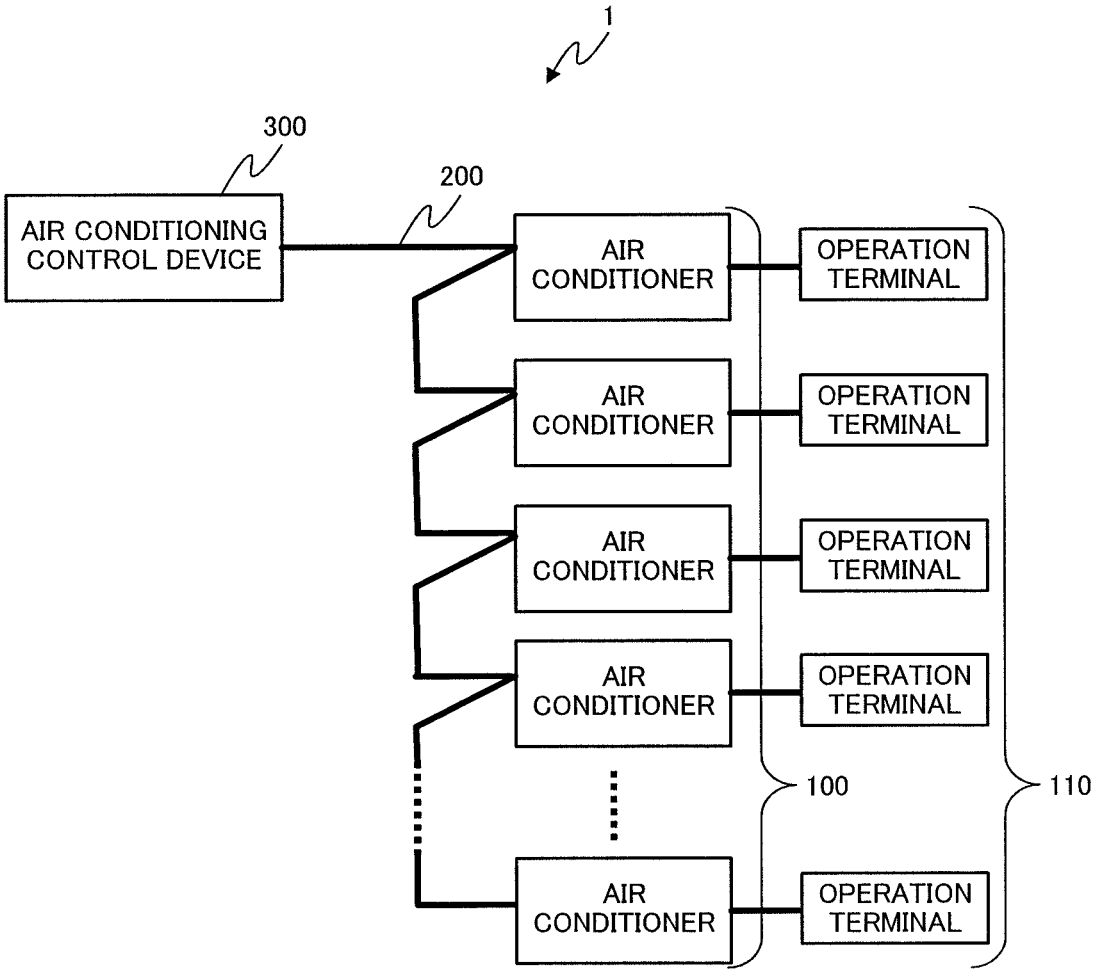
FIG. 1 is a diagram illustrating an air conditioning system including an air conditioning control device according to a first embodiment.

FIG. 1 is a diagram illustrating an air conditioning system including an air conditioning control device according to a first embodiment of the present invention. As illustrated in FIG. 1, an air conditioning system 1 is composed of a plurality of air conditioners 100, a plurality of operation terminals 110, a dedicated communication line 200 and an air conditioning control device 300. In the air conditioning system 1, the air conditioners 100 and air conditioning control device 300 are connected via the dedicated communication line 200 so as to communicate (exchange signals) with each other.

Each air conditioner 100 is composed of, for example, an indoor unit that lets indoor air in and out and a heat source unit (outdoor unit) including a compressor. Each air conditioner 100 may be any device that can control indoor temperature and humidity. Operation of each air conditioner 100 is controlled by the air conditioning control device 300 and the operation terminal 110 that is operated by a user, thereby regulating air condition so that a temperature in a space to be air-conditioned becomes a set temperature.

Each operation terminal 110 is connected to each air conditioner 100, and a user uses each operation terminal 110 to operate each air conditioners 100. A user can operate and stop each air conditioner 100, change an operation mode such as cooling and heating, and change a set temperature, wind direction and wind speed via each operation terminal 110.

The dedicated communication line 200 may be any wired or wireless communication route. The dedicated communication line 200 transmits any signal between the air conditioning control device 300 and each air conditioner 100.

Figure 2:
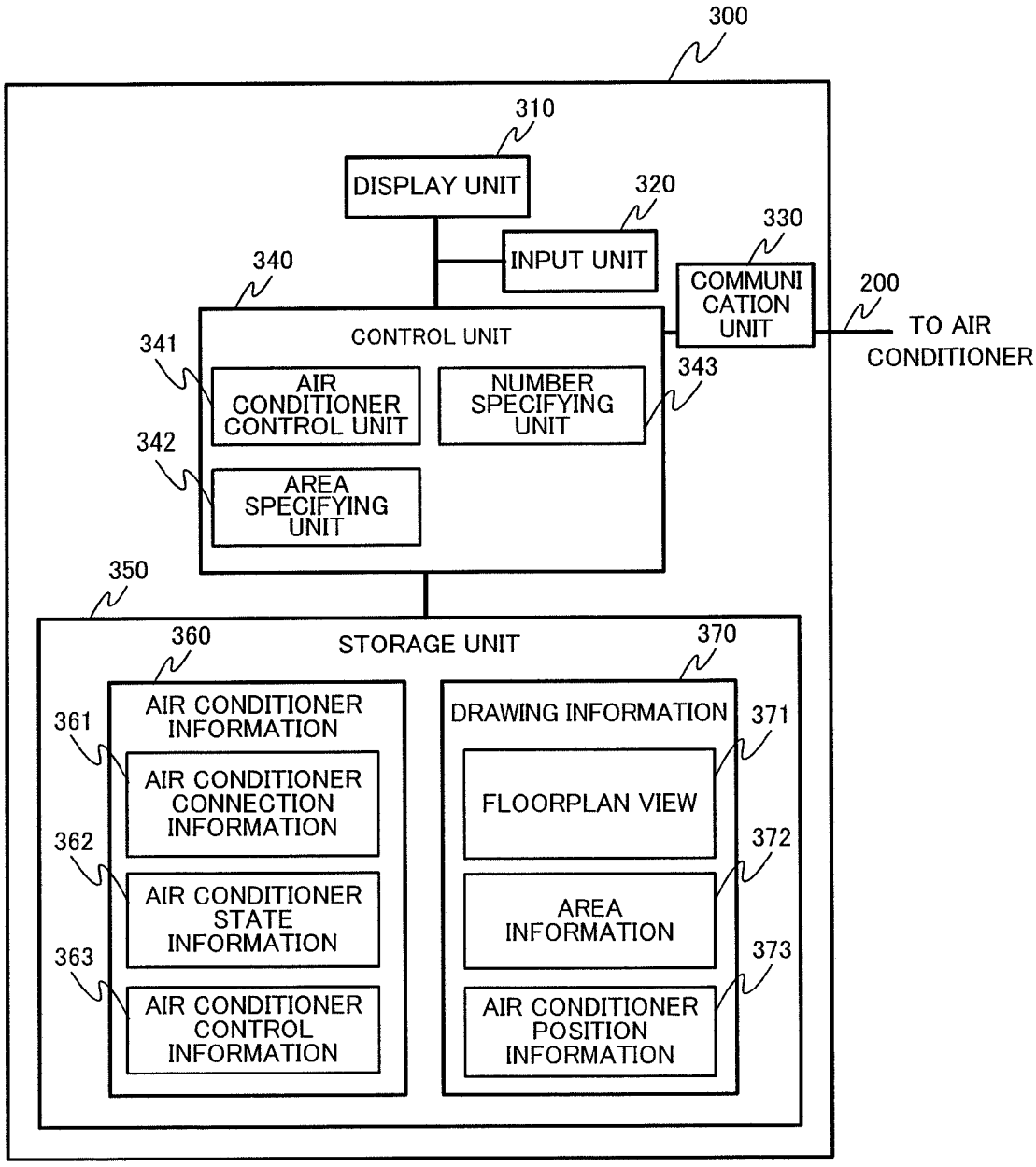
FIG. 2 is a diagram illustrating a configuration of an air conditioning control device.

The air conditioning control device 300 integrally controls the air conditioners 100 to control indoor air condition, thereby controlling power to be consumed by the air conditioners 100. FIG. 2 is a diagram illustrating a configuration of the air conditioning control device 300. As illustrated in FIG. 2, the air conditioning control device 300 includes a display unit 310, an input unit 320, a communication unit 330, a control unit 340 and a storage unit 350. Hereinafter, each component of the air conditioning control device 300 will be described.

The display unit 310 includes, for example, a dot matrix type LCD or an organic EL panel and a driver circuit, and displays any image. The display unit 310 displays, for example, the operation mode, set temperature, set wind direction and set airflow of each air conditioner 100.

The input unit 320 includes various types of keys, buttons, touch panel and/or the like to receive an instruction from a user and inputs various instructions and data to the control unit 340. A user can also control operation of the air conditioning control device 300 via the input unit 320. The input unit 320 includes an image reader to receive an image, inputs an image received from a user to the control unit 340 and/or the like.

The c communication unit 330 includes an interface for communication, and provides interface to communication between the air conditioning control device 300 and each air conditioner 100 via the dedicated communication line 200 according to a predetermined protocol.

The control unit 340 includes, for example, a central processing unit (CPU), a read only memory (ROM) and a random access memory (RAM), controls the entire operation of the air conditioning control device 300, and is connected to each component to exchange a control signal and data therewith. The control unit 340 also includes, for example, a real time clock (RTC), a timer and/or the like, and serves as a calendar and clock by timing (counting) time and date (including second, minute, hour, date and day of the week). The control unit 340 functionally includes an air conditioner control unit 341, an area specifying unit 342 and a number specifying unit 343. Hereinafter, each functional component of the control unit 340 will be described.

The air conditioner control unit 341 controls the air conditioners 100 of the air conditioning system 1. For example, the air conditioner control unit 341 changes settings (for example, operation mode such as cooling, heating, dehumidification and fanning, temperature, wind direction, airflow) of each air conditioner 100 to control air condition in a room where each air conditioner 100 is installed. The air conditioner control unit 341 operates or stops each air conditioner 100 for a predetermined time on the basis of a timer or clock. The air conditioner control unit 341 can control operation or stop and change settings of each air conditioner 100 on air conditioner-by-air conditioner basis.

The area specifying unit 342 specifies a separated area on the basis of a drawing stored in the storage unit 350. Here, an area means a predetermined region formed on a drawing illustrating a floorplan depicting where one or more air conditioners 100 are installed, typically, a room (place) separated by a wall or partition. The area specifying unit 342 first analyzes the drawing by dots to specify a hue of the largest number of dots having the same hue as a background color. Then, the area specifying unit 342 specifies using continuous dots of a hue different from the hue of the background color by a certain degree or more to form a line (representing for example, a wall, partition, or a room divider) surrounding an area. Then, the area specifying unit 342 specifies, a region within the specified line, as an area.

The number specifying unit 343 specifies a position of each air conditioner 100 on the basis of the drawing stored in the storage unit 350. The number specifying unit 343 specifies the number of air conditioners 100 within the area specified by the area specifying unit 342 on the basis of vertex coordinates of the area and coordinates of the specified position of each air conditioner 100. The number specifying unit 343, first, determines whether each air conditioner 100 is within the specified area on the basis of the number of intersection points of line segments that connect vertex coordinates of the area to each other and a line segment that connects predetermined coordinates on the drawing and position coordinates of each air conditioner 100. Then, the number specifying unit 343 counts one or more air conditioners 100 determined to be within the area to specify the number of air conditioners 100 within the area.

The storage unit 350 stores data necessary for the control unit 340 to perform processing. The storage unit 350 stores, for example, air conditioner information 360 and drawing information 370. The air conditioner information 360 includes air conditioner connection information 361, air conditioner state information 362 and air conditioner control information 363. The drawing information 370 includes a floorplan view 371, area information 372 and air conditioner position information 373. Hereinafter, information stored in the storage unit 350 will be described.

The air conditioner connection information 361 is information for specifying each air conditioner 100 provided in the air conditioning system 1. For example, the air conditioner connection information 361 includes any information regarding each air conditioner 100 connected to the dedicated communication line 200, such as address information, group information of the air conditioner 100 that belongs to a group by area, information associating the air conditioner 100 with an area where the air conditioner 100 is installed, and a model number of the air conditioner 100.

FIG. 3 is a table illustrating an example of air conditioner connection information 361 stored in the storage unit 350. As shown in FIG. 3, the air conditioner connection information 361 includes information indicating in which area each air conditioner is installed. For example, FIG. 3 shows that air conditioners 01 and 02 are installed in area 01, an air conditioner 03 is installed in area 02, and air conditioners 04 to 06 are installed in area 03.

Returning to FIG. 2, the air conditioner state information 362 is information indicating settings for each air conditioner 100. For example, the air conditioner state information 362 includes information indicating settings for each air conditioner 100 (an operation mode such as cooling, heating, dehumidification and fanning, a temperature such as 15° C. to 32° C., an airflow such as weak, medium and strong, and wind direction such as automatic, fixed, upward and downward).

The air conditioner control information 363 is information that is referred to when each air conditioner 100 is subjected to energy saving control. Here, energy saving control means any control to reduce power consumed by each air conditioner 100, such as control to stop operation of the air conditioner 100, control to increase a set temperature of the air conditioner 100 in cooling mode, or control to reduce an airflow of the air conditioner 100. The air conditioner control information 363 also includes information for controlling operation of one or more conditioners 100 that are grouped for each area on group-by group basis.

FIG. 4 is a table illustrating an example of the air conditioner state information 362 and air conditioner control information 363 stored in the storage unit 350. As shown in FIG. 4, the air conditioner state information 362 includes information of settings (operation mode, set temperature, set airflow, set wind direction) of each air conditioner 100. The air conditioner control information 363 includes operation information indicating a period during which each air conditioner performs energy saving control (energy saving control ON) and a period during which each air conditioner does not perform energy saving control (energy saving control OFF). For example, settings for the air conditioner 01 are as follows: operation mode is cooling, temperature is 25° C., airflow is low, wind direction is automatic, and energy saving control is performed from 2:00 to 20:00 each day. Settings for the air conditioner 02 are as follows: operation mode is dehumidification, temperature is 28° C., airflow is strong, wind direction is fixed, and energy saving control is performed from 0:00 to 6:00, 9:00 to 15:00 and 18:00 to 24:00 each day.

Returning to FIG. 2, the floorplan view 371 is image information representing a room where one or more air conditioners 100 are installed. The floorplan view 371 indicates, for example, positions of a floor, wall, room divider, partition, post, window and staircase.

The area information 372 is information indicating areas (rooms) into which a building floor is separated where one or more air conditioners 100 are installed, and includes, for example, coordinates (x direction, y direction) information indicating which region of the floorplan view 371 each area belongs to, information of area (planar dimension) of the area, and information of a shape of the area.

The air conditioner position information 373 is information indicating a position of each air conditioner 100, and includes, for example, information of an area where the air conditioner 100 is installed, and coordinates (x, y) information indicating in which position of the floorplan view 371 the air conditioner 100 is installed.

Figure 5:
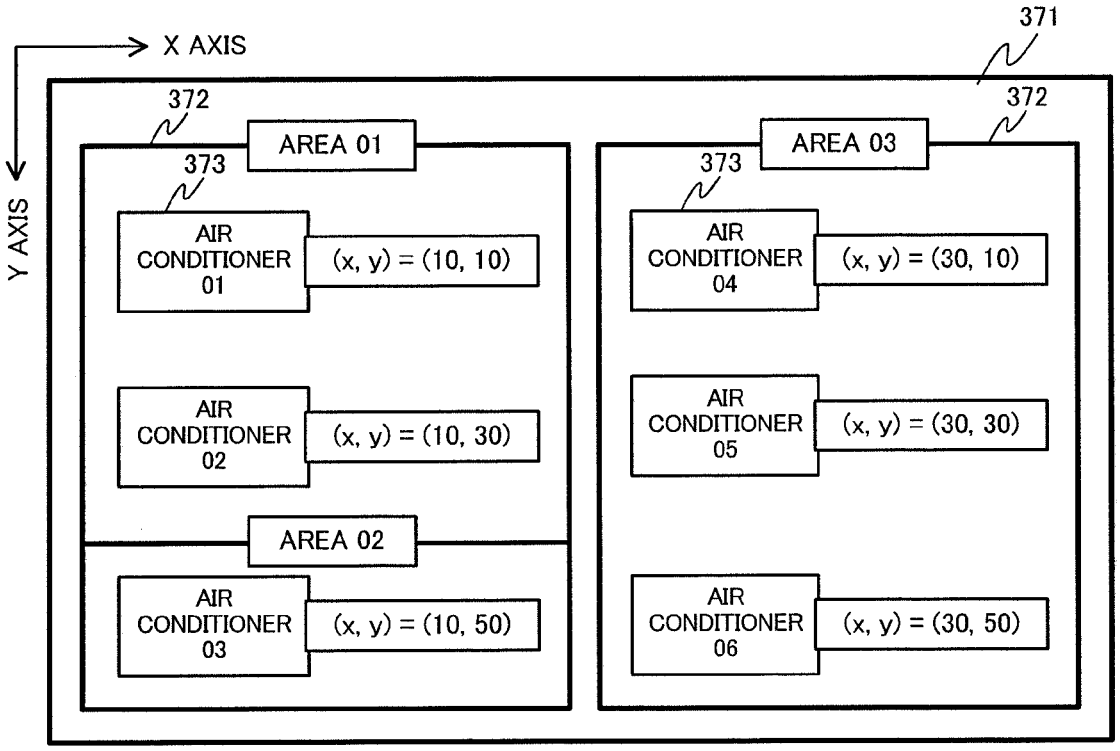
FIG. 5 is a diagram illustrating an example of area information and air conditioner position information displayed on a floorplan view.

FIG. 5 is a diagram illustrating an example of area information 372 and air conditioner position information 373 displayed on the floorplan view 371. As shown in FIG. 5, the floorplan view 371 is a floorplan view of a building floor, which shows area information 372 indicating areas into which the building floor is separated and air conditioner position information 373 indicating a position of each air conditioner 100.

Figure 6:
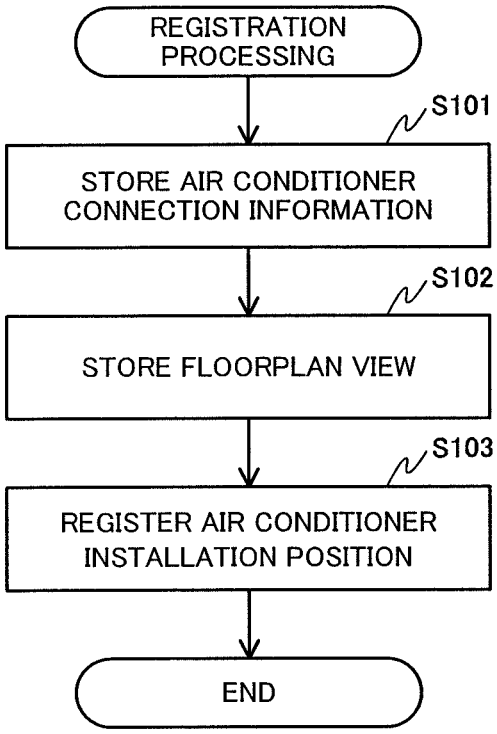
FIG. 6 is a flow chart for describing registration processing.

Next, operation of the air conditioning control device 300 shown in FIGS. 1 and 2 will be described. Processing to be performed by the air conditioning control device 300 is roughly divided into three types of processing: registration processing to designate position information of each air conditioner onto a floorplan view, number specifying processing to specify the number of air conditioners within an area, and air conditioner control processing to subject each air conditioner to energy saving control. First, registration processing will be described. FIG. 6 is a flow chart for describing registration processing. Hereinafter, registration processing will be described with reference to FIG. 6.

The air conditioning control device 300 prompts a user to perform registration operation and receives an input from the user, which starts the registration processing.

First, the input unit 320 receives air conditioner connection information for an air conditioner 100 to be managed that was input by the user and stores the information as air conditioner connection information 361 in the storage unit 350 (Step S101). By storing connection information of the air conditioner 100, the air conditioner 100 is recognized on the air conditioning system 1. The air conditioner 100 provided in the air conditioning system 1 receives a control signal from the air conditioning control device 300 to perform a predetermined operation.

Next, the input unit 320 receives a floorplan view 371 showing a location where the air conditioner 100 input by the user is installed, and stores the floorplan view 371 in the storage unit 350 (Step S102). The input unit 320 can not only receive an image showing a floorplan view 371 but also receive an input from a user to store in the storage unit 350 a drawing produced by the user.

Next, the input unit 320 receives an input from a user to register air conditioner position information 373 so as to display the air conditioner 100 stored at Step S101 on the floorplan view 371 stored at Step S102 (Step S103). For example, by directly inputting position coordinates of the air conditioner 100, a user can register a position of the air conditioner 100 onto the floorplan view 371. Alternatively, by manipulating (for example, drag, drop) an image (icon) of the air conditioner 100 displayed on the floorplan view 371, the air conditioner 100 can be registered at any position on the floorplan view 371. This registers information indicating air conditioner position information 373 on the floorplan view 371 as illustrated in FIG. 5 in the storage unit 350.

By performing the above processing, the floorplan view 371 and air conditioner position information 373 can be registered in association with each other.

Figure 7:
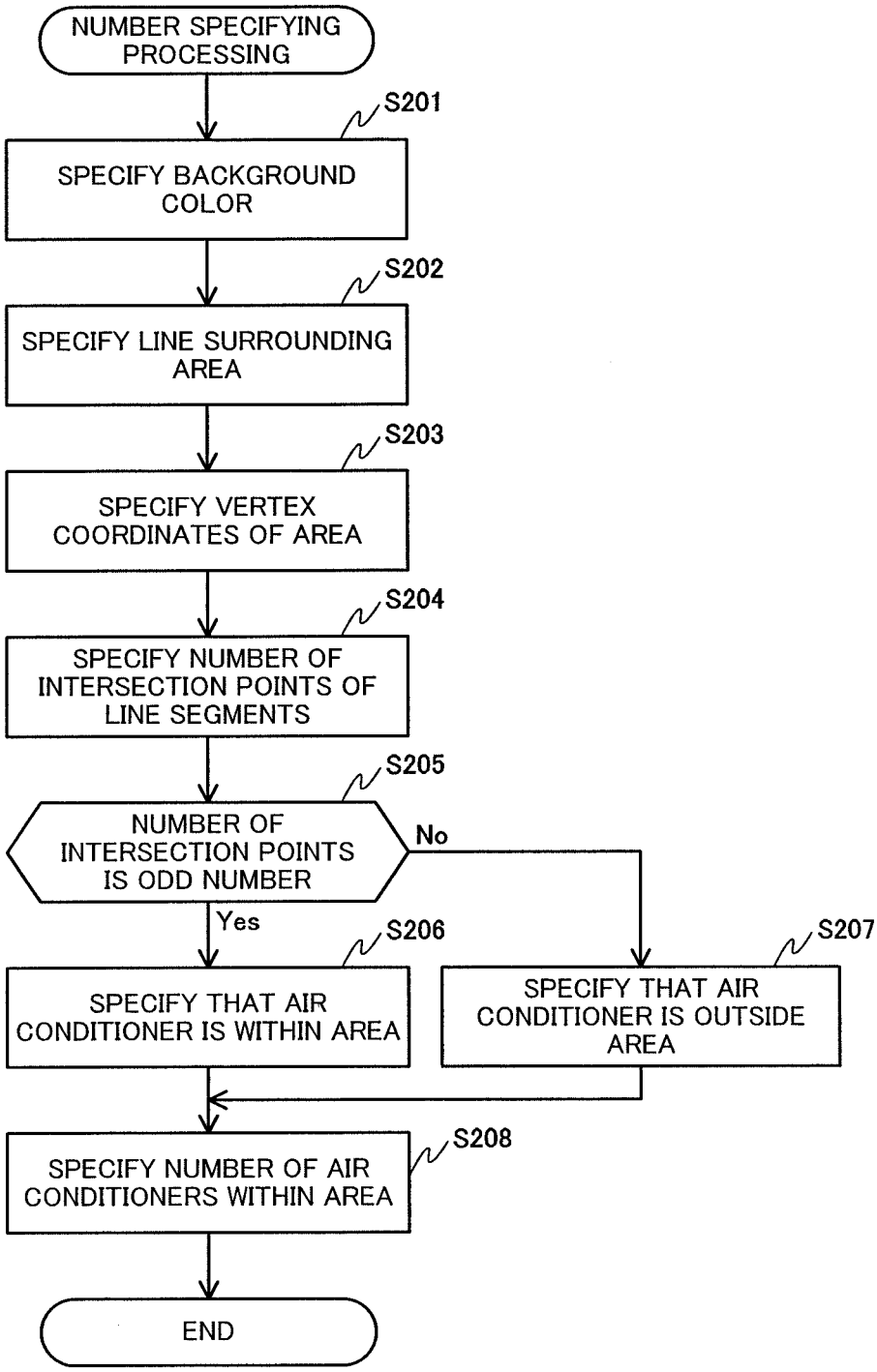
FIG. 7 is a flow chart for describing a process to specify the number of air conditioners.

Next, number specifying processing will be described. FIG. 7 is a flow chart for describing number specifying processing. Hereinafter, number specifying processing will be described with reference to FIG. 7.

Figure 8:
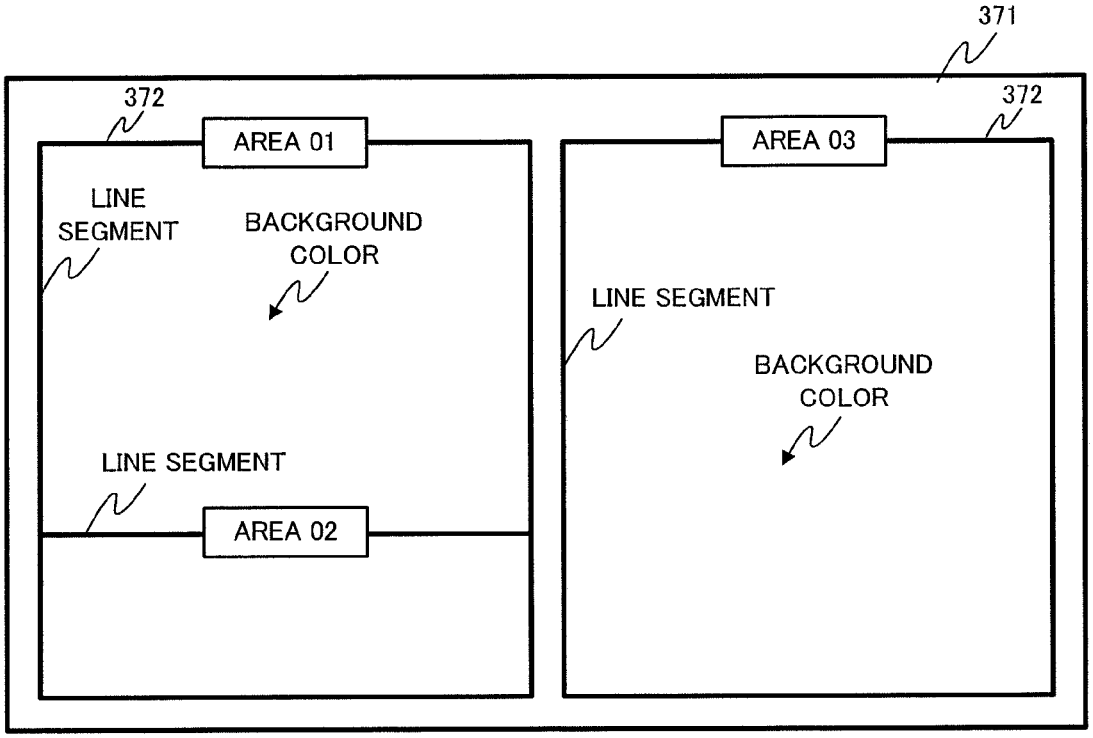
FIG. 8 is a diagram for describing a method to specify an area.

Once the floorplan view 371 is stored in the storage unit 350, the air conditioning control device 300 automatically starts a flow in FIG. 7. First, the area specifying unit 342 analyzes the floorplan view 371 to specify (distinguish) a background color of the floorplan view 371 in order to specify (distinguish) a separated area on the floorplan view (Step S201). FIG. 8 is a diagram for describing a method to specify an area. For example, the area specifying unit 342 analyzes color of an entire floorplan view 371 by dots to specify, a hue of the largest number of dots having the same hue, as a background color. In FIG. 8, since a hue of the largest number of dots having the same hue is white, the area specifying unit 342 specifies white as the background color.

Next, the area specifying unit 342 specifies continuous dots of a hue that is different from the hue of the background color by a certain degree or more as a line (for example, a wall or partition) surrounding an area (Step S202). In FIG. 8, since a hue different from the hue of the background color by a certain degree or more is black and a portion where the black dots are continuously arranged is a line, the area specifying unit 342 specifies three areas 01 to 03.

At this time, the area specifying unit 342 determines, for example, whether a hue of a dot is different from a hue of a background color by a certain degree or more, on the basis of differences of respective colors red (R), green (G), blue (B) of the hue of the dot. Let (R0, G0, B0) denote a hue (for example, color grade expressed by 16 gradations or 256 gradations) of a background color, and (R, G, B) a hue of a dot to be determined. The area specifying unit 342 performs determination by:

[Expression 1]

$$\sqrt{(R-R0)^2+(G-G0)^2+(B-B0)^2} \quad (1)$$

If a value found by Expression (1) is equal to or greater than a predetermined value, the area specifying unit 342 determines that the hue of the dot to be determined is different from the hue of the background color by a certain degree or more. A predetermined value is any value and can be changed for each floorplan view 371.

Figure 9:
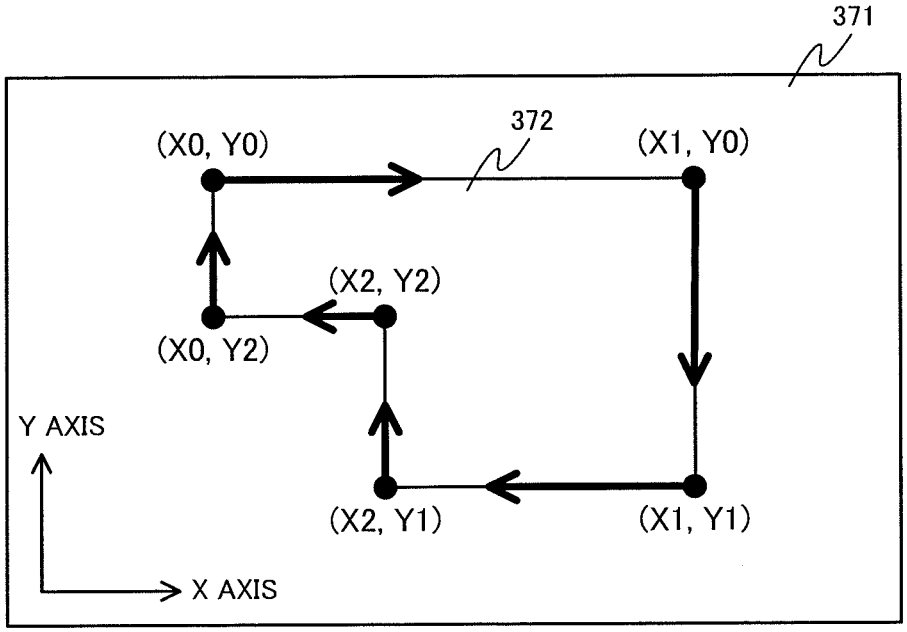
FIG. 9 is a diagram for describing a method to specify vertex coordinates of an area.

Next, the number specifying unit 343 specifies vertex coordinates of the area specified by the area specifying unit 342 (Step S203). FIG. 9 is a diagram for describing a method to specify vertex coordinates of the area where one or more air conditioners are installed. First, the number specifying unit 343 specifies positions at which vertical lines and horizontal lines forming an area intersect with each other as vertexes of the area, and then sets one of the specified vertexes to be vertex coordinates (X0, Y0). Next, the number specifying unit 343 selects vertex coordinates (X1, Y0) adjacent to vertex coordinates (X0, Y0) in the x axis direction (horizontal axis direction). Subsequently, the number specifying unit 343 selects vertex coordinates (X1, Y1) adjacent to vertex coordinates (X1, Y0) in the y axis direction (vertical axis direction). Then, the number specifying unit 343 selects vertex coordinates (X2, Y1) adjacent to vertex coordinates (X1, Y1) in the x axis direction (horizontal axis direction). At this time, the number specifying unit 343 selects the vertex coordinates so that X2 satisfies $X0 \leq X2 < X1$. Subsequently, the number specifying unit 343 selects vertex coordinates (X2, Y2) adjacent to vertex coordinates (X2, Y1) in the y axis direction (vertical axis direction). At this time, the number specifying unit 343 selects the vertex coordinates so that Y2 satisfies $Y0 \leq \times Y2 < Y1$. By repeating the above processing until vertex coordinates to be selected returns to (X0, Y0), the number specifying unit 343 designates a region surrounded by a group of selected vertex coordinates as an area. In FIG. 9, a region surrounded by vertex coordinates (X0, Y0), (X1, Y0), (X1, Y1), (X2, Y1), (X2, Y2) and (X0, Y2) becomes area information 372.

Next, the number specifying unit 343 specifies the number of air conditioners 100 within the area on the basis of position coordinates of each air conditioner 100 registered on the floorplan view 371 and the group of vertex coordinates of the area. The number specifying unit 343 specifies intersection points of line segments that forms the area, each line segment being formed by each two vertex coordinates, and a line segment connecting position coordinates of each air conditioner 100 and predetermined coordinates outside the area, in order to specify the number of air conditioners 100 within the area. The number specifying unit 343 specifies whether each air conditioner 100 is within an area or outside the area on the basis of whether the number of specified intersection points is an even number or an odd number (Steps S205 to S207).

Figure 10:
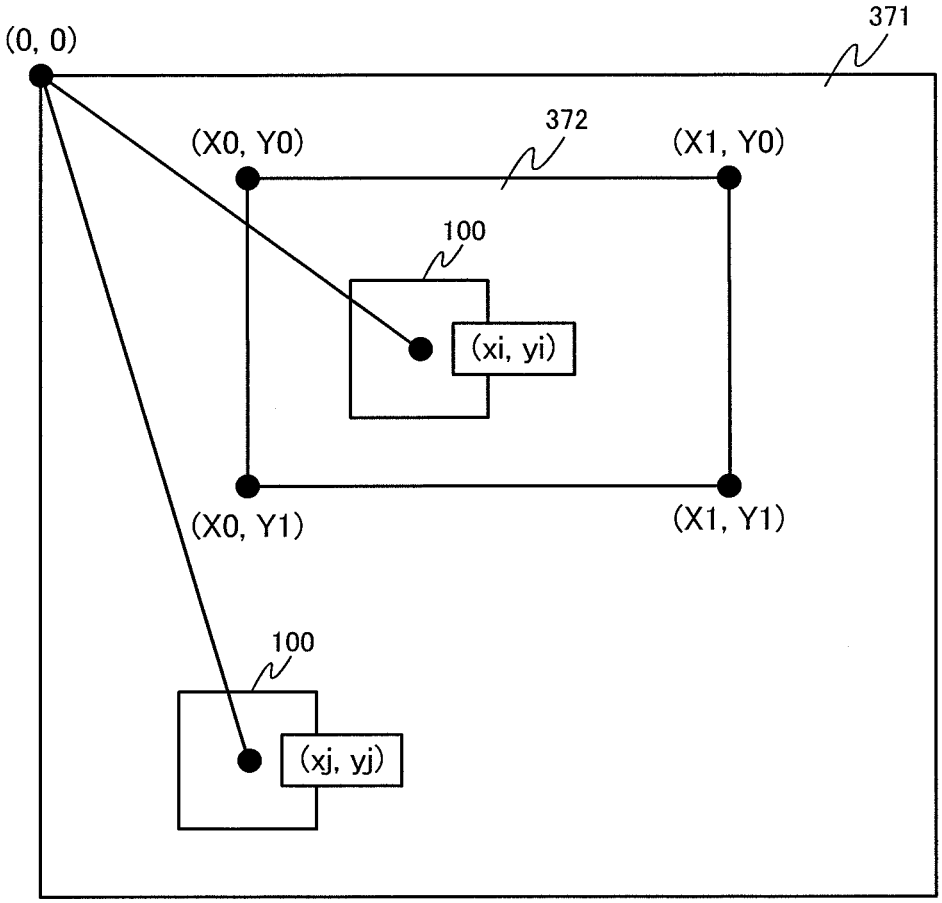
FIG. 10 is a diagram for describing a method to specify each air conditioner within an area.

FIG. 10 is a diagram for describing a method to specify whether each air conditioner 100 is inside or outside an area. First, the number specifying unit 343 sets coordinates of a dot indicating a corner of the floorplan view 371 to be (0, 0), and specifies a line segment (xi, yi)-(0, 0) that connects the coordinates (0, 0) and position coordinates (xi, yi) of the air conditioner 100 that is registered in air conditioner position information 373. Next, the number specifying unit 343 determines whether the line segment (xi, yi)-(0, 0) intersects with the line segments that forms the area 372, each line segment being formed by each two vertex coordinates, (for example, (X1, Y0)-(X0, Y0), (X1, Y1)-(X1, Y0), (X1, Y1)-(X1, Y0), (X1, Y1)-(X0, Y1), (X0, Y1)-(X0, Y0)).

Whether a line segment (x1, y1)-(x2, y2) and a line segment (x3, y3)-(x4, y4) intersect with each other is determined by:

[Expression 2]

$$x=x1+s(x2-x1)$$

$$y=y1+s(y2-y1)$$

$$x=x3+t(x4-x3)$$

$$y=y3+t(y4-y3) \quad (2)$$

If 's' a value found by Expression (2) satisfies the following expression (3), it is determined that the line segment (x1, y1)-(x2, y2) and the line segment (x3, y3)-(x4, y4) intersect with each other.

[Expression 3]

$$0<x\leq 1 \quad (3)$$

In FIG. 10, if position coordinates of the air conditioner 100 is (xi, yi), the number of intersection points of a line segment (xi, yi)-(0, 0) and respective line segments that are formed by respective two vertex coordinates, (X1, Y0)-(X0, Y0), (X1, Y1)-(X1, Y0), (X1, Y1)-(X0, Y1), (X0, Y1)-(X0, Y0) becomes 1 (=0+0+0+1). If the number of intersection points is an odd number, the number specifying unit 343 specifies that the air conditioner 100 is within the area.

Meanwhile, if position coordinates of the air conditioner 100 are (xj, yj), the number of intersection points of a line segment (xj, yj)-(0, 0) and respective line segments that are connected by respective two vertex coordinates, (X1, Y0)-(X0, Y0), (X1, Y1)-(X1, Y0), (X1, Y1)-(X0, Y1), (X0, Y1)-(X0, Y0) becomes 0 (=0+0+0+0). If the number of intersection points is an even number, the number specifying unit 343 specifies that the air conditioner 100 is not within the area.

Once each air conditioner 100 is specified, the number specifying unit 343 associates the air conditioner 100 with an area where the air conditioner 100 is installed, as illustrated in FIG. 3 and registers which area the air conditioner belongs to as area information 372. The number specifying unit 343 also displays an image illustrating area information 372 indicative of separated areas within a building floor and air conditioner position information 373 indicative of a position of each air conditioner 100 on a floorplan view 371, as illustrated in FIG. 5.

Then, the number specifying unit 343 counts one or more air conditioners 100 whose number of intersection points was determined to be an odd number to specify the number of air conditioners 100 within the area (Step S208). By specifying the number of air conditioners 100 within the area, the number specifying unit 343 can set the one or more air conditioners 100 within the area to be one group.

The above processing can specify the number of air conditioners 100 within the area specified by area information 372 shown on a floorplan view 371. Since the one or more air conditioners 100 to be subjected to energy saving control can be grouped by area, each air conditioner 100 can be controlled on group-by-group basis. In addition, since area information 372 can be obtained on the basis of the floorplan view 371, a user can introduce settings for realizing energy saving without a botheration of default setting or need of manual setting.

Figure 11:
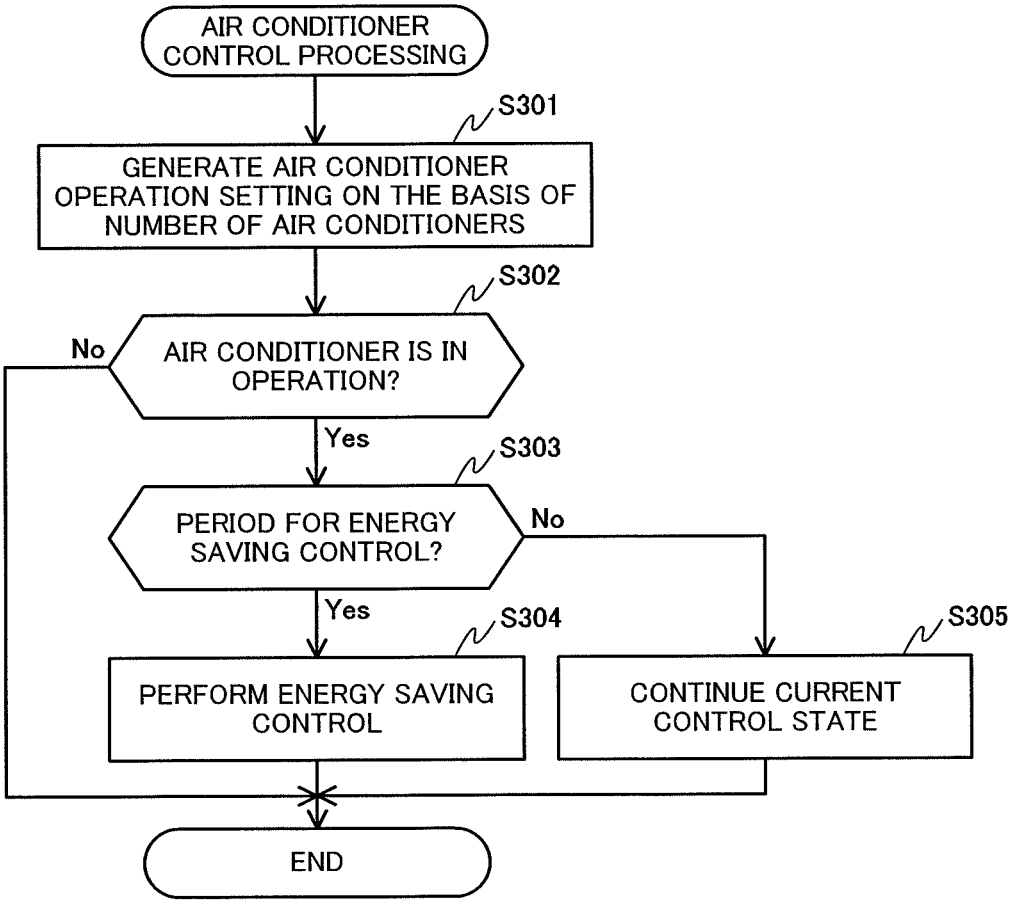
FIG. 11 is a flow chart for describing air conditioner control processing.

Next, air conditioner control processing will be described. FIG. 11 is a flow chart for describing air conditioner control processing. Hereinafter, the air conditioner control processing will be described with reference to FIG. 11.

First, the air conditioner control unit 341 creates operation setting of each air conditioner 100 on the basis of the specified number of air conditioners 100 within the area by the above processing (Step S301). FIG. 12 is a table illustrating an example of operation setting for controlling operation of each air conditioner 100. For example, where two air conditioners 01 and 02 are installed in area 01, the air conditioner control unit 341 sets a period for performing energy saving control that reduces power to be consumed by the air conditioner 100 (the time during which energy saving control is ON), to be longer, compared with a case where a single air conditioner is installed in an area. Where one air conditioner 03 is installed in area 02, the air conditioner control unit 341 does not perform energy saving control or sets time during which energy saving control is ON to be shorter, compared with other cases. Where three air conditioners 04 to 06 are installed in area 03, the air conditioner control unit 341 sets time during which energy saving control is ON to be longer, compared with a case where two air conditioners are installed in one area. Then, the air conditioner control unit 341 designates operation setting for each air conditioner 100 as air conditioner control information 363.

Next, the air conditioner control unit 341 determines whether a predetermined air conditioner 100 is operating (Step S302).

If a predetermined air conditioner 100 is not operating (Step S302; No), the air conditioner control unit 341 determines that energy saving is realized and terminates the present processing.

Meanwhile, if a predetermined air conditioner 100 is operating (Step S302; Yes), the air conditioner control unit 341 determines whether it is the time for the air conditioner 100 to perform energy saving control (Step S303).

If it is the time for the air conditioner 100 to perform energy saving control (Step S303: Yes), the air conditioner control unit 341 subjects the air conditioner 100 to energy saving control on the basis of air conditioner control information 363 (Step S304) and terminates the present processing.

Meanwhile, if it is not the time for the air conditioner 100 to perform energy saving control (Step S303; No), the air conditioner control unit 341 controls operation of the air conditioner 100 so that the current operating condition of the air conditioner 100 continues (Step S305) and terminates the present processing.

Since, by the above processing, each air conditioner 100 can be controlled by each area where the air conditioner 100 is installed, energy saving can be realized without reducing comfort. Even if a floorplan view 371 is changed, air conditioner control information 363 is automatically generated for subjecting each air conditioner 100 to energy saving control and therefore energy saving and comfort maintenance can be realized without setting by a user.

Second Embodiment

In the air conditioning system 1 including the air conditioning control device 300 according to the first embodiment, a case where one air conditioner 100 is connected to one operation terminal 110 has been described. However, in some air conditioning systems in a building or the like, one operation terminal may be connected to a plurality of air conditioners, and a user may operate the operation terminal to control operation of those air conditioners. In the present embodiment, there will be described a method in which where a plurality of air conditioners are connected to one operation terminal, an optimal energy saving control can be selected from two types of energy saving control depending on intended control: one being energy saving control on operation terminal-by-operation terminal basis and the other being energy saving control on air conditioner-by-air conditioner basis, thereby realizing energy saving. The same configuration and operation as those of the air conditioning control device 300 of the first embodiment will not be described.

Figure 13:
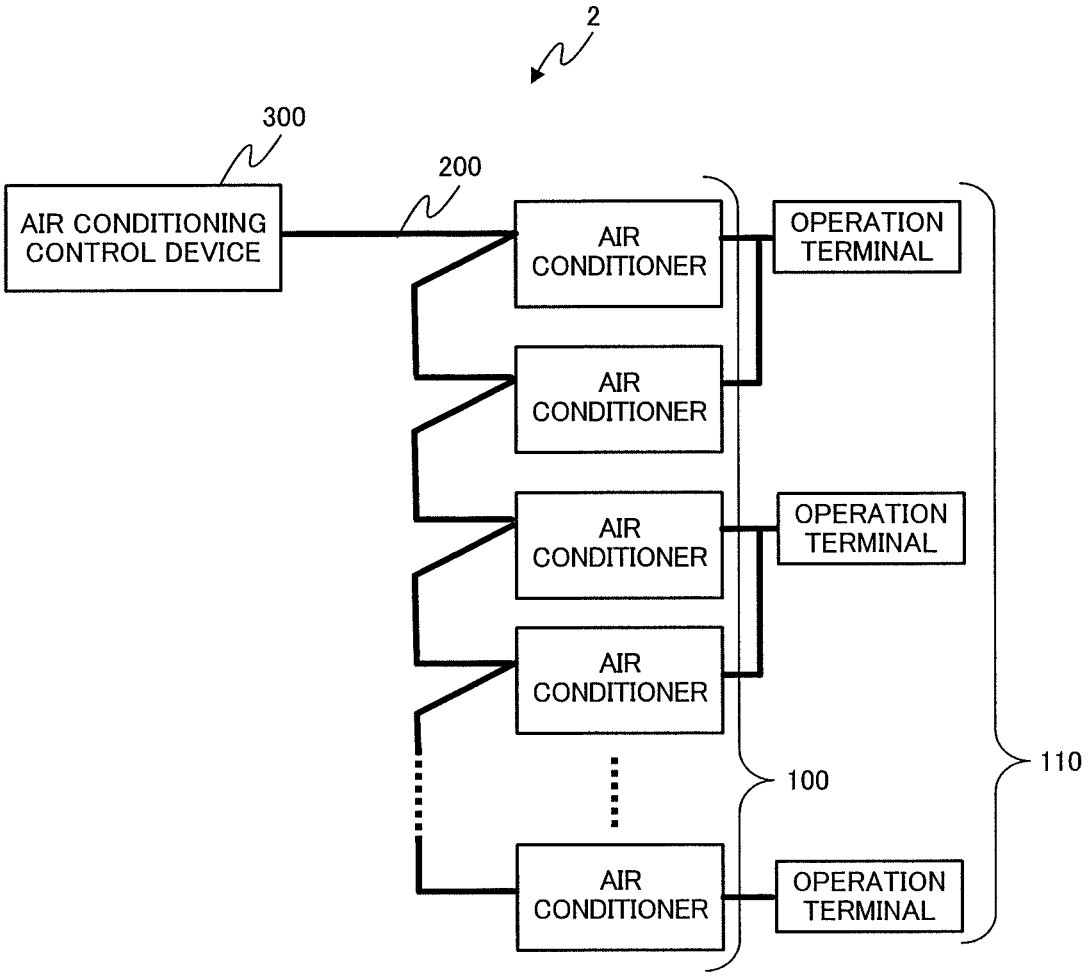
FIG. 13 is a diagram illustrating an air conditioning system according to a second embodiment.

FIG. 13 is a diagram illustrating an air conditioning system in which an air conditioning control device is connected according to a second embodiment. As shown in FIG. 13, an air conditioning system 2 includes a plurality of air conditioners 100, a plurality of operation terminals 110, the dedicated communication line 200, and the air conditioning control device 300. The air conditioners 100 are connected to one operation terminal 110. Operation conditions of those air conditioners 100 connected to the same operation terminal 110 are changed when the operation terminal 110 is operated.

Figure 14:
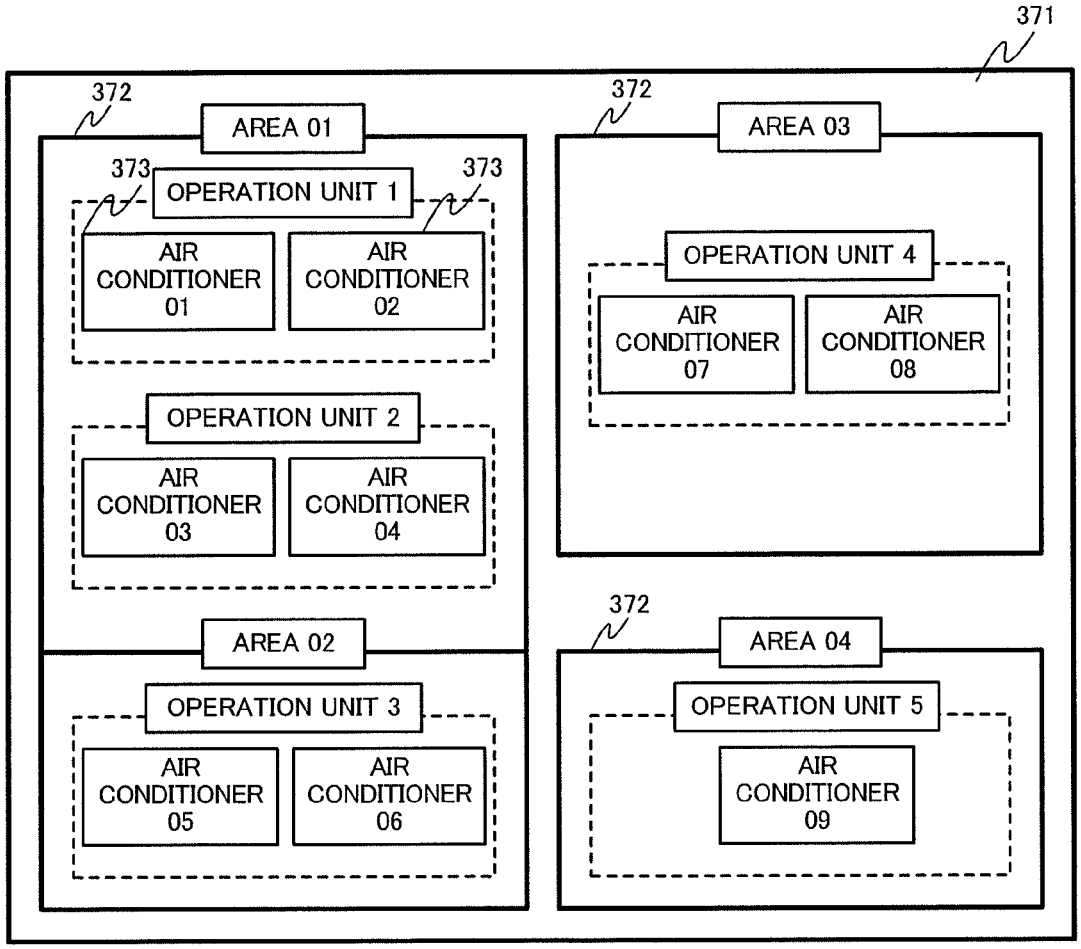
FIG. 14 is an example of a floorplan view in which air conditioners are separated into groups by each operation unit.

FIG. 14 is a diagram illustrating an example of a floorplan view in which one or more air conditioners are grouped for each operation unit. As shown in FIG. 14, air conditioners 01, 02 are registered in operation unit 1, air conditioners 03, 04 are registered in operation unit 2, air conditioners 05, 06 are registered in operation unit 3, air conditioners 07, 08 are registered in operation unit 4, and an air conditioner 09 is registered in operation unit 5. In the air conditioning system 2 and air conditioning control device 300 configured in this way, operation of energy saving control will be described where a plurality of air conditioners 100 are associated with one operation terminal 110.

Figure 15:
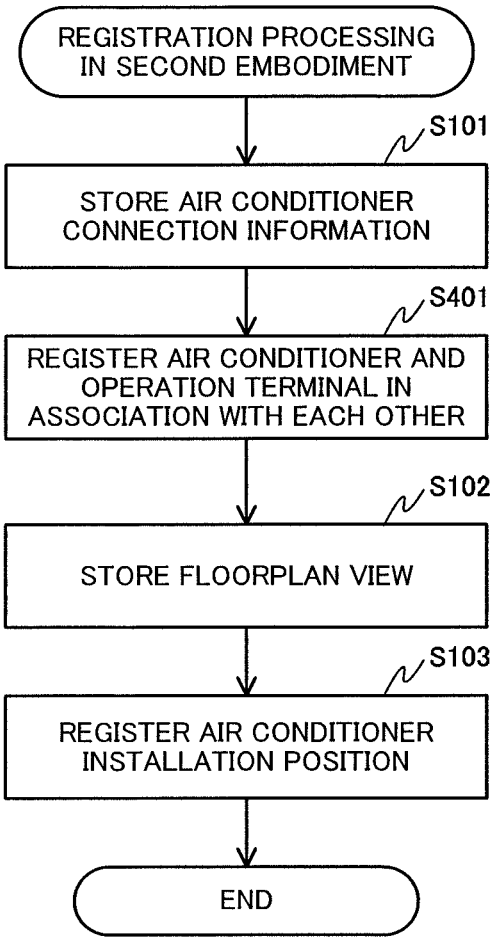
FIG. 15 is a flow chart for describing registration processing according to the second embodiment.

FIG. 15 is a flow chart for describing registration processing according to the second embodiment. Hereinafter, the registration processing will be described with reference to FIG. 15. Since operation at Steps 101 to 103 is the same as that of the first embodiment, description thereof will be omitted.

The input unit 320 receives connection information for each air conditioner 100 to which an operation terminal 110 is connected and registers the air conditioner 100 and operation terminal 110 in association with each other (Step S401). FIG. 16 is a table illustrating an example of air conditioner connection information of one or more air conditioners grouped for each operation unit. As shown in FIG. 16, for example, air conditioners 01, 02 are registered in operation unit 1, air conditioners 03, 04 are registered in operation unit 2, air conditioners 05, 06 are registered in operation unit 3, air conditioners 07, 08 are registered in operation unit 4, and an air conditioner 09 is registered in operation unit 5. The input unit 320 stores a corresponding relationship between each air conditioner 100 and the operation terminal 110 as air conditioner connection information 361.

Through the above processing, one or more air conditioners 100 included in each operation unit can be specified.

Figure 17:
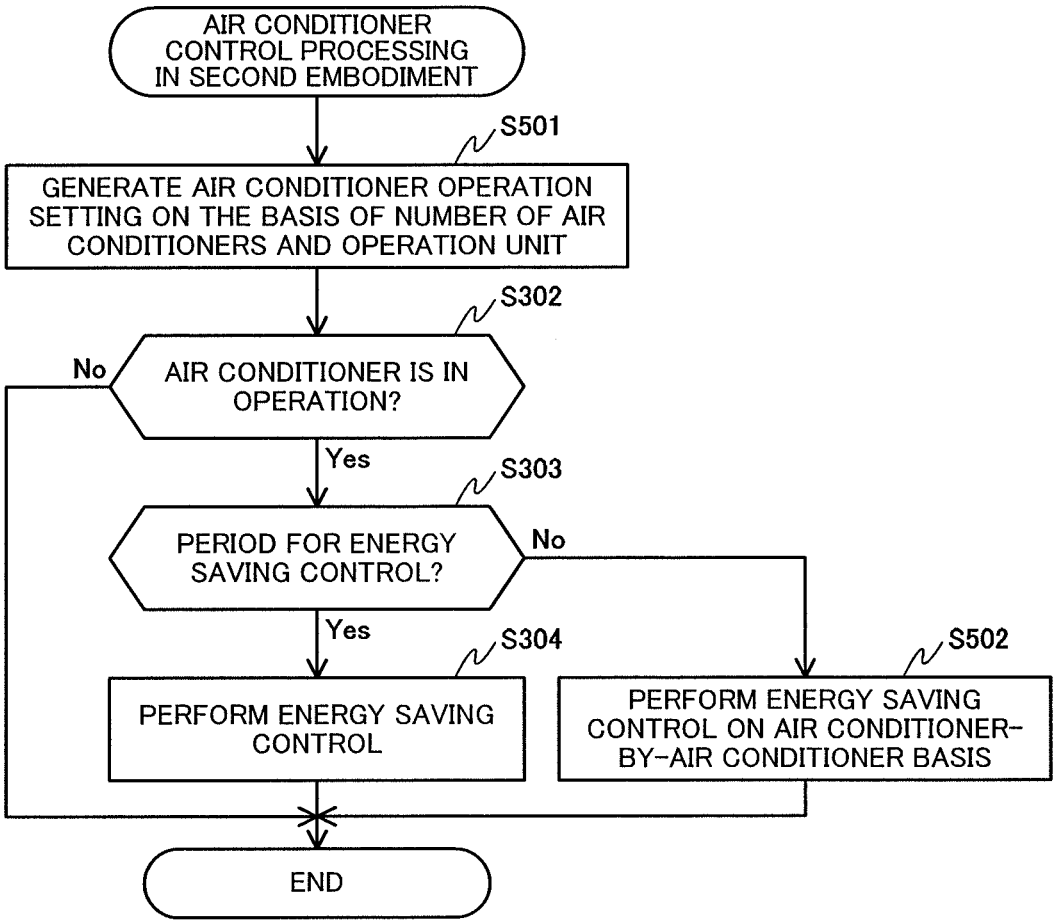
FIG. 17 is a flow chart for describing air conditioner control processing according to the second embodiment.

Next, a method to control operation of the one or more air conditioners grouped for each operation unit will be described. FIG. 17 is a flow chart for describing air conditioner control processing according to the second embodiment. Hereinafter, the air conditioner control processing will be described with reference to FIG. 17. Since operation at Steps 302 to 304 is the same as that of the first embodiment, description thereof will be omitted. Description of number specifying processing will be also omitted since operation thereof is the same as that of the first embodiment.

First, the air conditioner control unit 341 generates operation settings for each air conditioner 100 on the basis of the number of air conditioners 100 within the area specified by number specifying processing and an operation unit in which the air conditioner 100 is registered (Step S501). In the second embodiment, since operation of each air conditioner 100 is controlled on operation unit-by-operation unit basis, the air conditioner control unit 341 generates operation settings for the one or more air conditioners 100 in each operation unit on operation unit-by-operation unit basis. FIG. 18 is a table illustrating an example of operation settings for controlling operation of the one or more air conditioners grouped for each operation unit. For example, where four air conditioners 01 to 04 are installed in area 01 and two operation units are provided, the air conditioner control unit 341 sets a period during which energy saving control is ON to be longer, compared with a case where one area includes one operation unit. In areas 02 to 04, since each area includes only one operation unit, the air conditioner control unit 341 sets the period during which energy saving control is ON to be shorter, compared with a case where one area includes a plurality of operation units. Then, the air conditioner control unit 341 designates operation settings for each air conditioner 100 as air conditioner control information 363.

Next, if it is determined that it is not the period to perform energy saving control at Step S303 (Step S303; No), the air conditioner control unit 341 subjects each air conditioner 100 to energy saving control on air conditioner-by-air conditioner basis, not on operation unit-by-operation unit basis (Step S502). Each air conditioner 100, as a room temperature being an input, has a function of autonomously regulating a refrigerant flow rate to control a temperature of air blown from the air conditioner so as to approach a designated set temperature. However, in some cases, this control cannot be performed via an operation terminal 110. Therefore, even where a plurality of air conditioners 100 are registered for each operation unit, the air conditioner control unit 341 can transmit to each air conditioner 100 an instruction to forcibly block refrigerant flow (thermo OFF), thereby enabling the air conditioner to perform energy saving control. The air conditioner control unit 341 controls operation of each air conditioner 100 on air conditioner-by-air conditioner basis and terminates the present processing.

Since the above processing can set two types of energy saving control, that is, energy saving control on operation unit-by-operation unit basis and energy saving control on air conditioner-by-air conditioner basis, energy saving can be realized without reducing comfort.

The present invention is not limited to the above embodiments, and various variations and applications can be employed.

Any number of air conditioners 100 can be provided in the air conditioning systems 1 and 2.

Any number of air conditioners 100 can be connected to an operation terminal 110.

The air conditioning control device 300 can control not only operation of an air conditioner 100 but also operation of a heat source unit (outdoor unit) including a compressor.

The air conditioning control device 300 can control not only operation of an air conditioner 100 but also operation of any equipment such as a lighting equipment, a ventilator and/or an electric fan.

The display unit 310 can display area information 372 and air conditioner position information 373 with any color and brightness.

The display unit 310 can also display any information such as state information indicating operation or stop of each air conditioner 100 and warning information indicating a failure of each air conditioner 100.

The communication unit 330 can transmit and receive a signal via a communication network such as the Internet.

The floorplan view 371 may be composed of a floorplan view showing a building floor, or an image formed by a cubic diagram or polygon, or the like.

The air conditioner control unit 341 can perform energy saving control for any amount of time in order to realize energy saving. For example, the air conditioner control unit 341 can change an amount of time for energy saving control depending on whether it is morning or afternoon.

The air conditioner control unit 341 can change setting for energy saving control depending on date, day of week, time of day and/or the like. For example, the air conditioner control unit 341 can perform energy saving control with a set temperature of each air conditioner 100 being 28° C. for a weekday morning, and with a set temperature thereof being 27° C. for a weekday afternoon.

The air conditioner control unit 341 can change a set airflow and a set wind direction of each air conditioner 100 to perform energy saving control.

The area specifying unit 342 may separate hue into predetermined ranges, find to which range a hue of the largest number of dots in the floorplan view 371 belongs, and specify a median value of the range or an arithmetic mean value of the largest number of dots as a background color. For example, the area specifying unit 342 separates hue into three ranges: red, green and blue, and specifies to which range a hue of the largest number of dots in the floorplan view 371 belongs. Then, the area specifying unit 342 can specify a median value of the range (for example, red) to which a hue of the largest number of dots belongs as a background color.

The area specifying unit 342 may determine whether hues are different from each other by a certain degree or more on the basis of:

[Expression 4]

$$\sqrt{(R-R0)^2+(G-G0)^2+(B-B0)^2} \quad (4)$$

The area specifying unit 342 can not only find a distance between hues as the sum of a distance for each of (R, G, B) but also use any method to calculate a distance between hues.

In specifying a portion where dots having a predetermined hue are continually arranged as a line, the area specifying unit 342 can specify not only dots continuously arranged in a vertical direction and dots continuously arranged in a horizontal direction, but also any portion such as dots continuously arranged in an oblique direction and dots continuously arranged in a curve.

The number specifying unit 343 may not only acquire position information for each air conditioner 100 from coordinates position on the floorplan view 371, but also previously store position information of each air conditioner 100. Alternatively, the number specifying unit 343 can use a technology such as an ultra wide band (UWB) to specify a position of each air conditioner 100.

The number specifying unit 343 may not only set coordinates of a dot indicating a corner on the floorplan view 371 to be (0, 0), but also any point to be (0, 0).

In addition, the above hardware configurations and flow charts are merely examples, and can be arbitrarily changed and modified.

A main part that performs processing of the air conditioning control device 300 including the display unit 310, input unit 320, communication unit 330, control unit 340 and storage unit 350 can be realized by a common computer system, not a dedicated system. For example, the air conditioning control device 300 may be configured in such a way that a computer program for performing the above operation is stored and distributed in a computer-readable recording medium (a flexible disk, CD-ROM, DVD-ROM or the like) and the computer program is installed on a computer to perform the above processing. Alternatively, the air conditioning control device 300 may be configured in such a way that the computer program is stored in a storage device in a server device on a communication network such as the Internet, and is downloaded by a common computer system.

Where functions of the air conditioning control device 300 are divided between an operating system (OS) and an application program or realized by cooperation of OS and an application program, only an application program may be stored in a recording medium or a storage device.

A computer program can be superimposed on carrier waves and distributed via a communication network. For example, the computer program may be displayed on a bulletin board system (BBS) on the communication network and distributed via the network. Then, the computer program may be configured in such a way that the above processing may be performed by activating this computer program and executing the program under control of OS as other application programs The present application is based on Japanese Patent Application No. 2010-204974 filed on Sep. 13, 2010. The entire specification, claims and drawings of Japanese Patent Application No. 2010-204974 shall be incorporated herein by reference.

INDUSTRIAL APPLICABILITY

An air conditioning control device, an air conditioning control method and a program according to the present invention are suitable for input setting for each air conditioner.

DESCRIPTION OF REFERENCE NUMERALS

1, 2 Air conditioning system
100 Air conditioner
110 Operation terminal
200 Dedicated communication line
300 Air conditioning control device
310 Display unit
320 Input unit
330 Communication unit
340 Control unit
341 Air conditioner control unit
342 Area specifying unit
343 Number specifying unit
350 Storage unit
360 Air conditioner information
361 Air conditioner connection information
362 Air conditioner state information
363 Air conditioner control information
370 Drawing information
371 Floorplan view
372 Area information
373 Air conditioner position information

The invention claimed is:

1. An air conditioning control device comprising:

a storage unit configured to store a drawing illustrating a floorplan indicating where one or more air conditioners are installed and where separated areas are designated within the floorplan;

an area specifying unit configured to specify areas where the one or more air conditioners are installed on the basis of a hue of the stored drawing;

a number specifying unit configured to specify the number of air conditioners within the respective specified areas; and an air conditioner control unit configured to control operation of each air conditioner installed within the specified areas on the basis of the specified number of air conditioners.

2. The air conditioning control device according to claim 1, wherein the area specifying unit recognizes the stored drawing by dots to specify a hue of the largest number of dots having the same hue as a background color, continuous dots having a hue that is different by a certain degree or more from the hue of the specified background color as a line, and a region surrounded by the line as an area.

3. The air conditioning control device according to claim 1, wherein the air conditioner control unit performs control in such a way that the lower the number of air conditioners within the specified area is, the shorter time during which each air conditioner is off is.

4. The air conditioning control device according to claim 1, wherein the air conditioner control unit controls operation of each air conditioner on air conditioner-by-air conditioner basis, or by air conditioners that are connected to and controlled by each operation terminal.

5. The air conditioning control device according to claim 1, wherein the number specifying unit determines whether each air conditioner is within each of the areas on the basis of a line through vertex coordinates of the area specified by the area specifying unit and a line through coordinates indicating a position of the air conditioner on the drawing.

6. The air conditioning control device according to claim 5, wherein the number specifying unit determines whether each air conditioner is within each of the areas on the basis of the number of intersection points of a line surrounding the area specified by the area specifying unit and a line that connects a predetermined position outside the area and a position of the air conditioner on the drawing.

7. An air conditioning control method, implemented in a computing mechanism including at least a memory and a processing unit, comprising the steps of:

storing, in the memory, a drawing illustrating a floorplan indicating where one or more air conditioners are installed, separated areas within the floorplan, and a position of each air conditioner within the floorplan;

specifying, by the processing unit, areas and one or more air conditioners within the respective specified areas on the basis of a hue of the stored drawing;

specifying, by the processing unit, the number of air conditioners within each of the specified areas; and controlling, by the processing unit, operation of each air conditioner on the basis of the specified number of air conditioners within each of the areas.

8. A non-transitory computer-readable memory medium storing a program having a computer function as:

a storage unit configured to store a drawing illustrating a floorplan indicating where one or more air conditioners are installed and where separated areas are designated within the floorplan;

an area specifying unit configured to specify areas where the one or more air conditioners are installed on the basis of a hue of the stored drawing;

a number specifying unit configured to specify the number of air conditioners within the respective specified areas; and an air conditioner control unit configured to control operation of each air conditioner within the specified areas on the basis of the specified number of air conditioners.

* * * * *